United States Patent [19]

Jordan

[11] 4,095,629

[45] Jun. 20, 1978

[54] SELF-SERVICE GASOLINE PUMP HANDLE CLIP

[76] Inventor: Robert F. Jordan, R.F.D. #4, Merrow Rd., Auburn, Me. 04210

[21] Appl. No.: 556,935

[22] Filed: Mar. 10, 1975

[51] Int. Cl.[2] ..... B65B 3/04; G05G 5/06

[52] U.S. Cl. ..... 141/392; 251/90; 251/111; 74/526

[58] Field of Search ..... 141/1, 198, 206–229, 141/392; 251/111, 284, 285, 90, 101, 112; 24/3 E, 3 R, 73 B; 74/526

[56] References Cited

U.S. PATENT DOCUMENTS

| | | | |
|---|---|---|---|
| 629,347 | 7/1899 | Fallon | 251/90 X |
| 666,777 | 1/1901 | Pattman | 251/90 |
| 881,757 | 3/1908 | Winsor | 24/3 E |
| 1,068,961 | 7/1913 | Baker | 251/90 |
| 1,170,859 | 2/1916 | Walker | 24/3 E |
| 1,689,236 | 10/1928 | Fraser, Jr. | 251/112 X |
| 3,062,247 | 11/1962 | Botkin | 141/225 X |
| 3,520,338 | 7/1970 | Vest et al. | 141/206 X |
| 3,589,413 | 6/1971 | Vest et al. | 141/206 X |

FOREIGN PATENT DOCUMENTS

| | | | |
|---|---|---|---|
| 471,691 | 9/1937 | United Kingdom | 251/90 |

*Primary Examiner*—Richard E. Aegerter
*Assistant Examiner*—Frederick R. Schmidt

[57] ABSTRACT

A removable clip for gasoline pump handles without a pump lever lock is provided, easily attachable to a gasoline pump handle and easily engageable to lock the pump handle lever without need for further manual holding.

7 Claims, 6 Drawing Figures

SELF-SERVICE GASOLINE PUMP HANDLE CLIP

The present invention relates to a new self-service gasoline pump handle clip.

Especially at self-service gasoline stations, gasoline pump handles may not be provided with a lock on the handle to maintain the flow of gasoline without continual manual holding.

Although many gasoline pump handles of the past have an integral lock mechanism, no such lock has been provided so that the gasoline customer may use his own lock where none is provided at the gas station.

For the customer, especially of a self-service gas station where the gasoline pump handle has no integral lock, the customer may attach a gasoline pump handle clip from his own possession, while the gasoline is being pumped. Thus, the continual manual handling of the pump handle is not required. The customer may also be free to follow other desired routines while the tank is being filled, but in any event, the customer does not have to continually hold the gasoline pump.

Once the tank has been filled to the customer's desire, the gasoline pump handle clip of the present invention may be removed and taken with the customer for use at the next occasion when the customer encounters a gasoline pump handle that does not have its own lock.

The gasoline pump handle clip of course may be used by others such as attendants at gasoline stations where the gasoline pump handles have no integral locks, as the situation warrants.

According to the present invention, a separately attachable gasoline pump handle clip is provided, which a user may optionally attach to gasoline pump handles which are not provided with locks. The gasoline pump handle clip is removable for reuse on the same or other gasoline pump handles. The gasoline pump handle clips of the present invention are also optionally adjustable to selected rates of gasoline flow and may be adapted for right or left-handed use.

Although such novel feature or features believed to be characteristic of the invention are pointed out in the claims, the invention and the manner in which it may be carried out, may be further understood by reference to the description following and the accompanying drawings.

Referring now to the figures in greater detail, where like reference numbers denote like parts in the various figures.

Figures 1, 2, 3, 4, 5, 6:
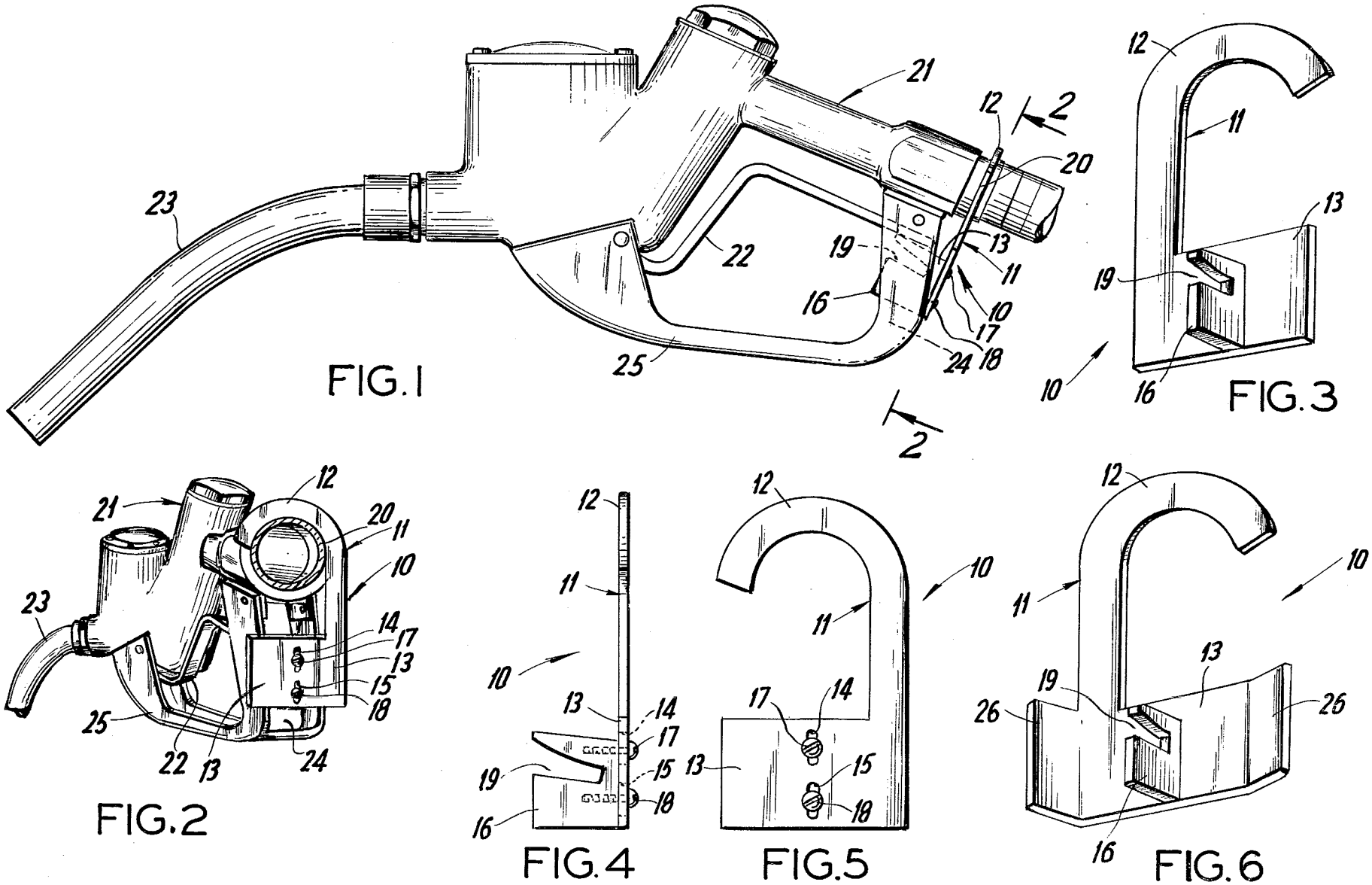
FIG. 1 is an elevation of a gasoline pump handle clip of the the present invention engaged on a gasoline pump handle.
FIG. 2 is an isometric view of FIG. 1 at lines 2—2.
FIG. 3 is an isometric elevation of the present invention.
FIG. 4 is a side elevation of FIG. 3.
FIG. 5 is a rear view of FIG. 3.
FIG. 6 is an isometric elevation of another embodiment of the present invention.

The gasoline pump handle clip 10 as shown in the figures has a base frame 11 generally comprising a hook 12 and a plate 13.

The plate 13 preferably is provided with slots 14, 15. A latch 16 is attached to the plate 13, as shown in FIGS. 1, 2, 4 and 5 by screws 17, 18 which pass through the slots 14, 15 and into the latch 16.

While the preferred embodiment of the gasoline pump handle 10 of the present invention employs the slots 14, 15 and screws 17, 18, the integral relationship of latch 16, hook 12 and plate 13, as shown in FIG. 3, is the functional relationship of the parts as will be later described in greater detail.

The latch 16 may be vertically adjusted on the plate 13 along the slots 14, 15, then reset by tightening the screws 17, 18.

As shown in FIGS. 1, 3 and 4, the latch 16 is provided with an optional additional catch 19.

In FIG. 6, another embodiment of the present invention is shown in which a pair of wings 26 are shown extending at an angle from the plate 13.

The purpose of the angulation of these wings 26 is to protrude beyond the width of the lever guard 25 of the gasoline pump handle 21 as shown in FIG. 2.

In the event a gasoline pump handle 21 falls while the clip 10 is engaged, the protrusion of the wings 26 engages the ground and its angulation disengages the clip 10 from the pump handle lever 22 as a safety precaution.

The wings 26 extend at an angle outward from said plate to provide a wider span of said gas pump handle clip 10 so that on contacts with the ground there is a lever action as between the ground, the gas pump handle 21 and the gas pump handle clip 10 to disengage the gas handle pump handle clip 10 from the handle lever 22. The top-heavy nature of the gas pump handle 21 tends to rest the gas pump handle 21 on one side or another to engage one of the wings 26 in the event the gas pump handle 21 engages the ground.

In operation, the hook 12 of the gas pump handle clip 10 is attached over the end 20 of a gasoline pump handle 21 as shown in FIGS. 1 and 2 in right-handed configuration. The handle lever 22 is then lifted to pump gasoline after the nozzle 23 is engaged in the gas tank opening (not shown).

After the handle lever 22 is lifted, the plate 13 of the gas pump handle clip 10 is moved forward and the latch 16 is protruded through the slot 24 of the lever guard 25 and under the handle lever 22. The handle lever 22 may be engaged on top of latch 16 or in the catch 19, depending on the speed at which it is desired for the gasoline to be pumped.

The back pressure on the handle lever 22 holds the handle lever 22 and gasoline pump handle clip 10 steady while gasoline is being pumped.

The latch 16 may be adjusted vertically as hereinbefore mentioned, to increase or decrease the setting for gasoline flow when the handle lever 22 rests on the latch 16 or in the catch 19.

When gasoline pumping is finished, the plate 13 and latch 16 are rotated backward on the hook 12, then the hook 12 can be removed from the pump handle end 20 and kept for reuse whenever required.

The terms and expressions which are employed are used as terms of description; it is recognized, though, that various modifications are possible.

Having thus described certain forms of the invention in some detail, what is claimed is:

1. In combination with a gasoline pump handle, said gasoline pump handle including an end portion, a lever guard, a pump lever, said pump lever having a free end, a slot in said lever guard, said slot adjacent the free end of said pump lever, a gasoline pump handle clip comprising a frame including a hook and a plate depending from said hook, and latch means intermediate of said plate extending outward from said plate and adapted to extend through said slot and engage said pump lever to lock said lever without need for further manual holding, said hook adapted to freely attach to said end of said gasoline pump handle.

2. The invention of claim 1 wherein said latch includes at least one catch.

3. The invention of claim 1 wherein said hook, plate and latch are one integral unit.

4. The invention of claim 1 including at least one opening in said plate and means fastening said latch to said plate through said at least one opening.

5. The invention of claim 4 wherein said at least one opening is at least two longitudinal slots.

6. The invention of claim 5 wherein said means to fasten said latch are screw means.

7. The invention of claim 1 wherein said plate includes a pair of wings extending at an angle outward of said plates.

* * * * *